United States Patent [19]

Strecker

[11] 4,326,707

[45] Apr. 27, 1982

[54] HYDRAULIC EXERCISER

[76] Inventor: Dennis C. Strecker, 1079 Colonial Club Dr., Harahan, La. 70123

[21] Appl. No.: 72,037

[22] Filed: Sep. 4, 1979

Related U.S. Application Data

[63] Continuation-in-part of Ser. No. 946,440, Sep. 27, 1978, abandoned.

[51] Int. Cl.[3] ..... A63B 21/00

[52] U.S. Cl. ..... 272/130; 272/125; 272/134

[58] Field of Search ..... 272/130, 141, 142, 93, 272/129; 254/386, 392

[56] References Cited

U.S. PATENT DOCUMENTS

| | | | |
|---|---|---|---|
| 410,533 | 9/1889 | Clayton | 254/386 |
| 1,188,760 | 6/1916 | Hagenbucher | 254/386 |
| 3,348,712 | 10/1967 | Hanson | 254/386 |
| 3,359,802 | 12/1967 | Sollenberger | 272/130 |
| 3,387,843 | 6/1968 | Chandler | 272/130 |
| 3,397,884 | 8/1968 | Blasi | 272/142 |
| 3,451,271 | 6/1969 | Knoblauch | 272/130 |
| 3,606,318 | 9/1971 | Gilstrap | 272/130 |
| 3,784,194 | 1/1974 | Perrine | 272/130 |
| 3,822,599 | 7/1974 | Brentham | 272/130 |

FOREIGN PATENT DOCUMENTS

| | | | |
|---|---|---|---|
| 405617 | 4/1967 | Australia | 272/130 |
| 650009 | 2/1951 | United Kingdom | 272/130 |
| 2029243 | 3/1980 | United Kingdom | 272/130 |

*Primary Examiner*—Richard J. Johnson
*Attorney, Agent, or Firm*—C. Emmett Pugh

[57] ABSTRACT

Hydraulic exerciser comprising a hydraulic control circuit, a single acting positive displacement pump, and an exercise machine designed using the control circuit and pump. With the hydraulic control circuit up to four modes and one combination of modes of exercising are possible; namely isometric, isodynamic, isokinetic, warmup and the combination of isodynamic and isokinetic. In addition the control circuit has a gage for registering the resistive force for all modes or combination of modes of exercising.

9 Claims, 5 Drawing Figures

HYDRAULIC EXERCISER

CROSS REFERENCES TO RELATED APPLICATION

This is a continuation-in-part of prior, copending application Ser. No. 946,440, filed Sept. 27, 1978, now abandoned, and entitled "Hydraulic Exerciser," the disclosure of which is incorporated herein by reference.

BACKGROUND OF INVENTION

1. Field of the Invention

The present invention relates to an exercising device or system, and more particularly to such a device or system using hydraulic means as a force resisting component.

2. Prior Art and Invention

The advantage of a hydraulic exercise machine are numerous and have been extensively cited in many previous patents as are the advantages of the various modes of exercising. The advantage of the combination of exercise modes (isodynamic and isokinetic) is explained further in the cross reference.

There are a number of prior art hydraulic exercise devices generally speaking similar in one respect or another to the type disclosed. However, there are none which are in combination as versatile, compact, smoothly operated and as easily constructed as the one disclosed. Most prior art hydraulic exercise devices use pumps with separate inlet and outlet ports, such as a hydraulic cylinder with a piston and hydraulic fluid on both sides of the piston. The two port type of design results in increase product cost over the single port design because of the required increase in the number of hydraulic circuit components, sliding seals, and precision machined surfaces. The performances of these machines are also degraded by the total increase in frictional seal resistance as a result of the extra seals.

Some prior art hydraulic exercise devices require careful balancing between two independent hydraulic circuits which is a difficult and tedious operation. The use of two hydraulic circuits in the design is also costly since it requires duplicating the components of a one circuit design.

Other prior art hydraulic exercise devices use more than one pump for the exercise machine. These devices are not only more expensive, but those, which use two or more hydraulic pumps that are basically mechanically independent and require load sharing for smooth exercising, run into trouble with differential seal friction among the pumps. This results in uneven operation and possible jamming of the exercise machine. An example of these exercise machines are the ones which use two hydraulic cylinders with a connecting bar for barbell type exercises.

Other prior art hydraulic exercise devices use a spring loaded relief valve for the isodynamic exercise mode. The device disclosed herein uses a weight loaded relief valve for the same purpose because of the psychological reinforcement of handling weights and because of the increase repeatability in obtaining a given level of exercise effort over a long term and from machine to machine.

The hydraulic exercise devices of the present invention by their inherent design eliminate the above mentioned shortcomings of the prior art. With the disclosed pump of the preferred embodiment only one sliding seal and seal surface is required and only one pump is required per machine, even if two mechanical outputs are required. Also, only one hydraulic circuit is required per machine. Jamming of the machine is completely eliminated by the design even with uneven loading. Also, the design of the hydraulic circuit is of minimum complexity since the hydraulic pump is single acting with a common inlet and outlet port.

A feature of the disclosed invention which it is believed is not available in any other exercise device is the combination of isokinetic and isodynamic modes. Many people who exercise with isokinetic machines get lulled into exerting a force which is somewhat less than their capacity. This is because the faster the isokinetic machine is worked, the greater the required force and vice versa. So, if a person is pyschologically down, he will tend to exert less by exercising slower which is easily done on an isokinetic machine. This shortcoming is eliminated by the combination of modes which sets a bottom limit to the exercise effort but allows any effort above the bottom limit to fluctuate in an isokinetic fashion. In this way the person exercising can set the isodynamic mode to something near his capacity, as this will prevent him from relaxing or working less than this setting. Also, most isokinetic machines have a dead band at the beginning of an exercise stroke and at the end of an exercise stroke. The dead band is the time or distance it takes to accelerate and deaccelerate the exercise machine to a point where meaningful exercising can be done. As a result the person exercising looses the very beginning and ending of an exercise movement. With the combination of modes in the present invention the dead band is nearly eliminated, since the machine will not move until the bottom limit of the exercise effort is exceeded.

SUMMARY OBJECTS OF INVENTION

An object of the invention is to provide an exercising machine which eliminates the need for large and potentially dangerous weights.

Another object of the invention is to provide an exercising machine which can be used to perform isometric exercises.

Another object of the invention is to provide an exercising machine which can be used to perform isokinetic exercises with a range of machine speeds for a given exercise effort.

Another object of the invention is to provide an exercising machine which can be used to perform isodynamic exercises.

Another object of the invention is to provide an exercising machine which can be used to perform warmup exercises.

Another object of the invention is to provide an exercising machine which can be used to perform a combination of isodynamic and isokinetic exercises with a range of machine speed for a given exercise effort.

Another object of the invention is to provide an exercising machine which registers the force exerted during an exercise.

Another object of the invention is to provide an exercise machine which in the isodynamic mode uses small weights, which are a fraction of the exercise effort in force, for controlling the exercise effort.

Another object of the invention is to provide an exercise machine which can be readily varied for isokinetic, isometric, isodynamic, warmup or a combination of isodynamic and isokinetic exercises.

Another object of the invention is to provide a single acting, positive displacement pump for use in constructing exercise machines and which can be used with the aforementioned control circuit and that has up to two mechanical inputs.

Another object of the invention is to provide an exercise machine which can be mounted in any position for numerous types of exercises.

Another object of the invention is to provide an exercise machine which is jam resistant.

Another object of the invention is to provide an exercise machine which provides a hydraulic resistance only during the exercise stroke.

Another object of the invention is to provide an exercise machine which is relatively inexpensive to construct because of its design.

Another object of the invention is to provide an exercise machine which can be used with a bar for barbell type excercises or with individual handgrips for dumbell type exercises.

Another object of the invention is to provide an exercise machine which is not confined to a rigid exercise path.

Another object of the invention is to provide an exercise machine which is compact and occupies little space.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAIL DESCRIPTION OF PREFERRED EMBODIMENT

This detailed description is arranged to give an overall view of how the preferred embodiment of the exercise machine of the present invention operates using the control circuit, the exercise mechanism and the pump. The description will then go into a detailed description of the control circuit, the pump and the exercise mechanism.

Figure 1:
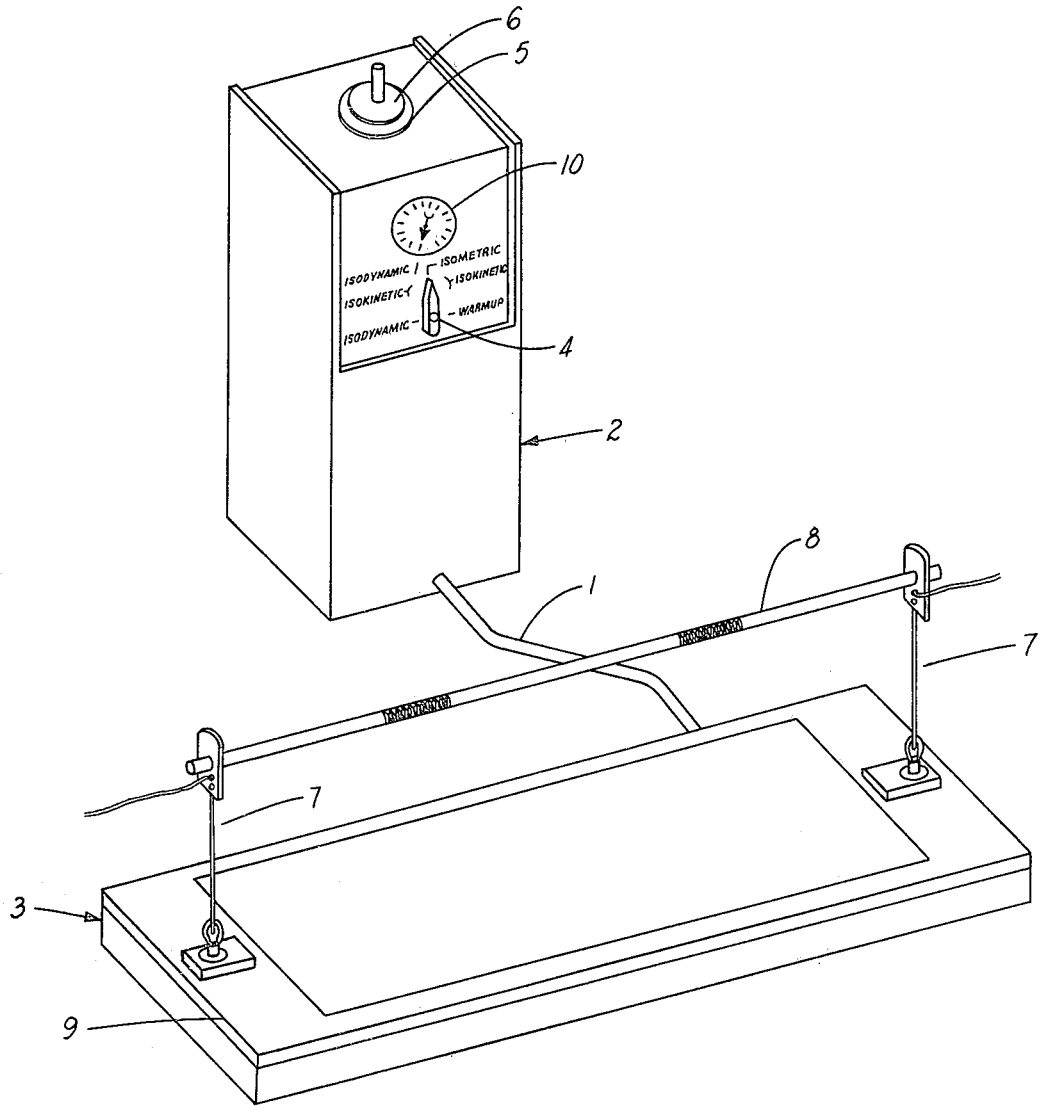
FIG. 1 is an isometric view of the complete exercise machine.

The complete exercise machine shown in FIG. 1 is divided into two units connected hydraulically by the line 1. The control module 2 contains all the hydraulic circuit components except the pump. The exerciser module 3 contains the pump and the mechanical mechanisms required for a useful exercise machine. To operate the machine the person exercising selects the mode of exercising desired by turning the handle 4 (note associated valve 14 of FIG. 2) to the appropriate position. The modes are warmup, isodynamic, isokinetic, isometric and the combination of isodynamic and isokinetic modes. In the isodynamic mode the exercise effort will be held constant as determined by the amount of weight on the platter 5. In the isokinetic mode the exercise effort will vary with the speed of the exercise movement. The isokinetic mode is broken down into a range of speed settings so that the person exercising can exercise faster or slower for a given exercise effort. In the isometric mode exercise effort will vary according to the person's effort, however, the machine will not move. In the combination of isodynamic and isokinetic modes the bottom limit of the exercise effort is set by the weights 6 (comparable to weights 20 in FIG. 3) on the platter 5 (comparable to platter 22 in FIG. 3) and the top limit is allowed to fluctuate as with the isokinetic mode. Like the isokinetic mode the combination mode is broken down into a range of speed settings so that the person exercising can exercise faster or slower for a given exercise effort above the minimum.

If the isodynamic or the combination of isodynamic and isokinetic modes is selected, the person would then put the amount of weight desired on the platter 5. The amount of weight on the platter 5 is multiplied by the machine so that the exercise effort required by the person is many times that of the weight placed on the platter 5 (i.e. four lbs of weights 6 might by equivalent to an exercise effort of eighty pounds). The desired weight is made up by combining convenient individual and incremental weights 6.

After the exercise mode is selected, the person lengthens or shortens the lines 7 (identical to lines 44 in FIG. 5) such that the bar 8 (identical to bar 35 in FIG. 5) is at the proper position for beginning the exercise stroke. The person then grips the bar 8 and begins exercising by raising it in the upward direction. If the person is standing or is otherwise resting on the exerciser module cover 9 (identical to top cover 46 of FIG. 5) the exerciser module 3 will not require fastening to the floor; otherwise suitable fastening is required. The exerciser's effort is continously recorded on the gage 10 during the exercise.

Figure 2:
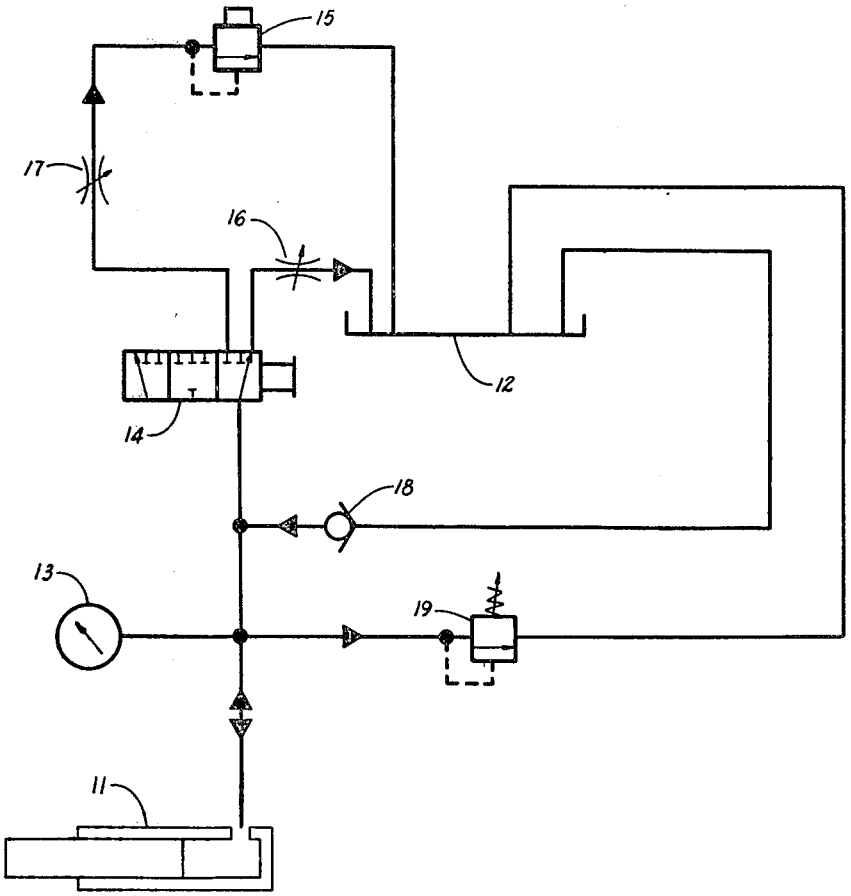
FIG. 2 is a schematic of the hydraulic circuit. To the extent possible symbols used correspond to the American National Standard Institute (ANSI) fluid power graphic symbols.

Reference is made to FIG. 2. Hydraulic fluid is expelled from the hydraulic pump 11 during the exertion stroke of an exercise. During the return stroke of an exercise, hydraulic fluid is forced back into the pump 11 by the combination of the atmospheric pressure on the reservoir 12 and a mechanical return mechanism, such as a spring, acting on the pump 11.

The pressure gage 13 is used to register the force on the hydraulic pump 11. The gage 13 may be calibrated as desired. In addition, a manually resettable following pointer may be used in conjunction with the gage pointer to indicate the maximum forced reached during an exercise. The gage 13 is not necessarily required for operation of the circuit and therefore may, for one reason or another, be deleted.

The valve 14 is one with two outlets and one inlet and a block inlet position. This valve 14 is used to select the different modes of exercising under the operation of handle 4 (note FIG. 1). One of the most economical valves to use for this is an infinitely positional rotary ball valve with one inlet and two outlets and which has a dead space, usually between the outlets, where flow to either outlet is blocked. The dead space can be used for isometric exercises, the flow to one outlet for the isodynamic exercises and the flow to the other outlet for warmup exercises. Isokinetic exercises can be performed by positioning the valve such that flow is partially blocked due to the misalinement in the rotor port and outlet port for warmup exercising. Depending upon the alinement between these two ports, different orifice adjustments may be obtained. Likewise if the valve is positioned in the direction of the isodynamic mode such that an orifice is created between the valve rotor port and outlet port to the pressure regulating valve 15, a combination of isokinetic and isodynamic exercising can be done. The use of the ball valve of the type described eliminates the need for valve 16 and valve 17 from the hydraulic circuit.

The valve 16 is an adjustable flow control valve or an adjustable orifice. It is used to regulate hydraulic flow in a manner such that, the greater the flow rate, the higher the pressure drops across it and the greater the exertion on the exercise machine. In this manner isokinetic exercises are performed. The valve 17 is of the same type as valve 16. Valve 17 is used in conjunction with the pressure regulating valve 15 for combining the isokinetic and isodynamic modes. Both valves 16 and 17 can be eliminated by using the ball valve as described.

The valve, 18 is a check valve and it permits hydraulic fluid to flow to the pump 11 from the reservoir 12 during the pump's expansion stroke. On the other hand, flow in the opposite direction is not permitted through the valve 18.

The valve 19 is a pressure relief valve used to limit the maximum pressure in the hydraulic circuit. The valve 19 may be the adjustable pressure type as shown or it may be the fixed pressure type. With the proper pressure adjustment the valve 19 can be used to protect the mechanical elements of a particular exercise machine from over stress. The valve 19 is not necessarily required and may be deleted for reasons of economics. However, many applications will justify its inclusion.

Figure 3:
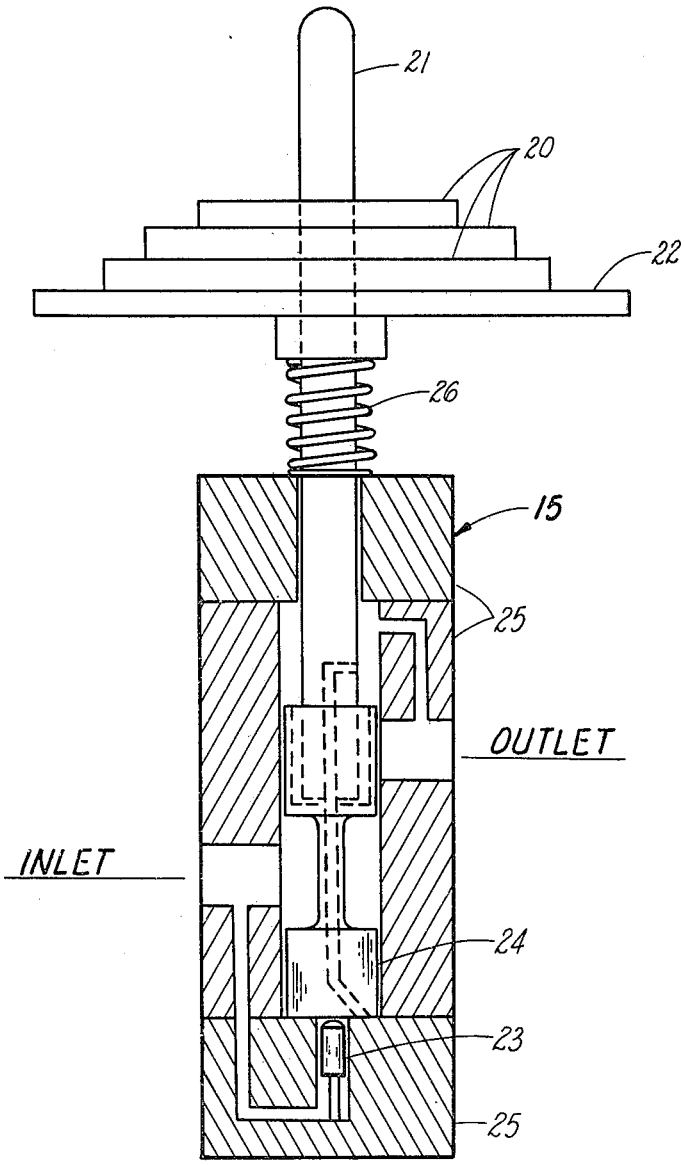
FIG. 3 is a sectional drawing of the pressure regulating valve.

The valve 15 is an adjustable pressure relief valve and is used for isodynamic exercises. This valve 15 is the type such that, when the cracking pressure is exceeded, the valve 15 opens enough so that the excess pressure is relieved. If the pressure drops below the cracking pressure, the valve 15 closes. The valve 15 is adjustable by adding or removing weights. The amount of weights on the valve 15 is directly proportional to the cracking pressure. The types of valves which are readily adaptable for this application are the spool types of adjustable pressure relief valves. These valves have a spool which is used for directing the fluid flow. The spool is operated by a small piston, exposed on one end to system pressure and opposed on the other end by a spring. The spring force is adjustable by means of a screw which compresses the spring. The valve may be used in this configuration with a suitable knob and scale for adjusting the spring and cracking pressure. However, the spring and screw can be removed from most valves and replaced with a rod 21 and a platter 22 (comparable to platter 5 of FIG. 1) fixed to the rod 21, as shown in FIG. 3, on which weights 20 (comparable to weights 6 of FIG. 1) may be placed. In this manner the weights 20 instead of the spring 26 counteracts the force of the piston 23 on the spool 24 to provide pressure regulation.

Since the rod 21 on which the platter 22 and weights 20 rest must pass through the body 25 of the valve 15, a rod seal seems necessary. However, the rod seal may be eliminated if the hydraulic system is 1st open or vented to the atmosphere, 2nd the valve 15 placed at the highest elevation of the system, and 3rd provided the spool 24 on the rod 21 end is drained into the reservoir 12. The elimination of the rod seal is significant since the frictional resistance of this seal would hamper the performance of the valve 15.

The spring 26 between the body 25 of the valve 15 and the platter 5 is used to provide a slight uplift on the platter 22 and weights 20 when the valve 15 is closed. The spring 26 is installed so that when the valve 15 begins to open, the spring 26 becomes fully extended. In this manner the spring 26 is used to compensate for the viscous forces of the spool 24 and rod 21 and the inertia forces of the spool 24, rod 21, platter 22 and weights 20 as the valve 15 opens.

Other types of valves, which may be used with the spring or the spring similarly removed as described, are known as balanced piston relief valves. These valves are characterized by a piston with balanced pressure on each side when closed. Through the piston is a small orifice and on one side is a small spring loaded poppet. When the pressure exceeds the spring setting on the poppet, the poppet opens. This in turn produces a differential pressure across the piston and causes it to shift and open a passage in the valve from the inlet port to the outlet port.

Refering back to FIG. 2, the reservoir 12 is used to hold the excess fluid in the hydraulic circuit which occurs due to the volume change of the pump 11 during an exercise. The reservoir 12 is shown vented to atmosphere. However, it could be designed as a closed pressurized reservoir. The advantage of the closed reservoir is that the pump 11 would automatically return without an external force; provided it is free to do so. The problems with the closed system is that it is leak prone and seals or other means are required to prevent fluid from leaking past the rod 21 that supports the weights 20 for the valve 15.

Figure 4:
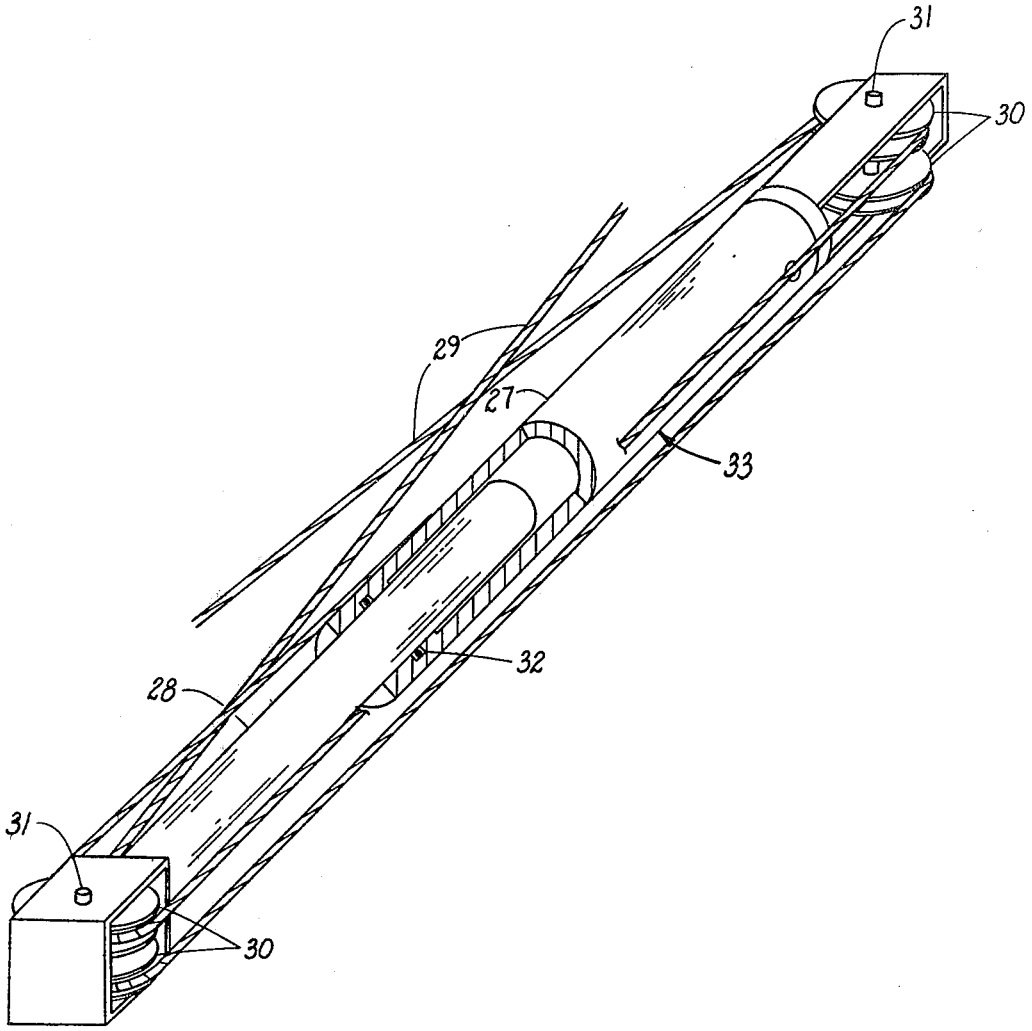
FIG. 4 is an isometric drawing of the single acting positive displacement pump.

The pump 11 shown in FIG. 2 is a positive displacement, single acting type and is identical in hydraulic performance to the one shown in FIG. 4.

Reference is made to FIG. 4. FIG. 4 is an isometric view of the pump. The pump 33 is positive displacement single acting. Unless the pump 33, as shown, is used with a pressurized, closed loop, hydraulic system, it will require a mechanical device such as a spring or other suitable means to return it after completion of the pumping stroke. The return mechanism can be designed into the exercise machine on which the pump 33 is used, or as an alternative a spring can be placed inside the cylinder 27 and/or hollowed out ram 28 such that it will expand the pump 33 by applying pressure against the ram 28 and the back of the cylinder 27.

The compression stroke is accomplished by applying a suitable force to the ends of the wire rope 29. The sheaves 30 and wire rope 29 act together to transfer the load or pull force on each end of the wire rope 29 to the ram 28 and cylinder 27. The sheaves 30 and wire rope 29 arrangement have two important advantages. First, with the single wire rope 29 used, up to two outputs are possible, one on each end of the wire rope 29, and secondly equal loads on each end of the wire rope 29 will result in equal movement at the ends. Even slightly unequal loads on each end will result in uniform movement at the ends since the inherent frictional forces in the sheaves 30 tends to compensate for the unequal loads on the ends. This principle can be easily understood if one would suspend two equal weights from the ends of a wire rope which passes over a sheave. In order to move either weight, an additional force, in excess of the sheave's frictional force, must be added to one of the weights. The importance of this lies in the fact that similar muscle groups on each side of the human body may differ slightly in strength. Therefore, exercising machines designed for working both sets of muscles simultaneously should be designed to compensate for possible unequal loading. Also, if one end of the wire rope 29 was fixed, the other end would still be allowed to move without any binding of the ram 28 or cylinder 27; thus the pump 33 can be used for machines requiring one output.

Each sheave 30 is individually rotatably mounted. The ratio of the wire rope 29 movement to the ram 28 movement as shown is four to one. By using more sheaves 30, the ratio can be increased and vice versa. In place of the sheaves 30 and wire rope 29, sprockets may be used with roller chains.

The shafts 31 are used for mounting the sheaves 30 to the end of the ram 28 and cylinder 27 as shown.

Figure 5:
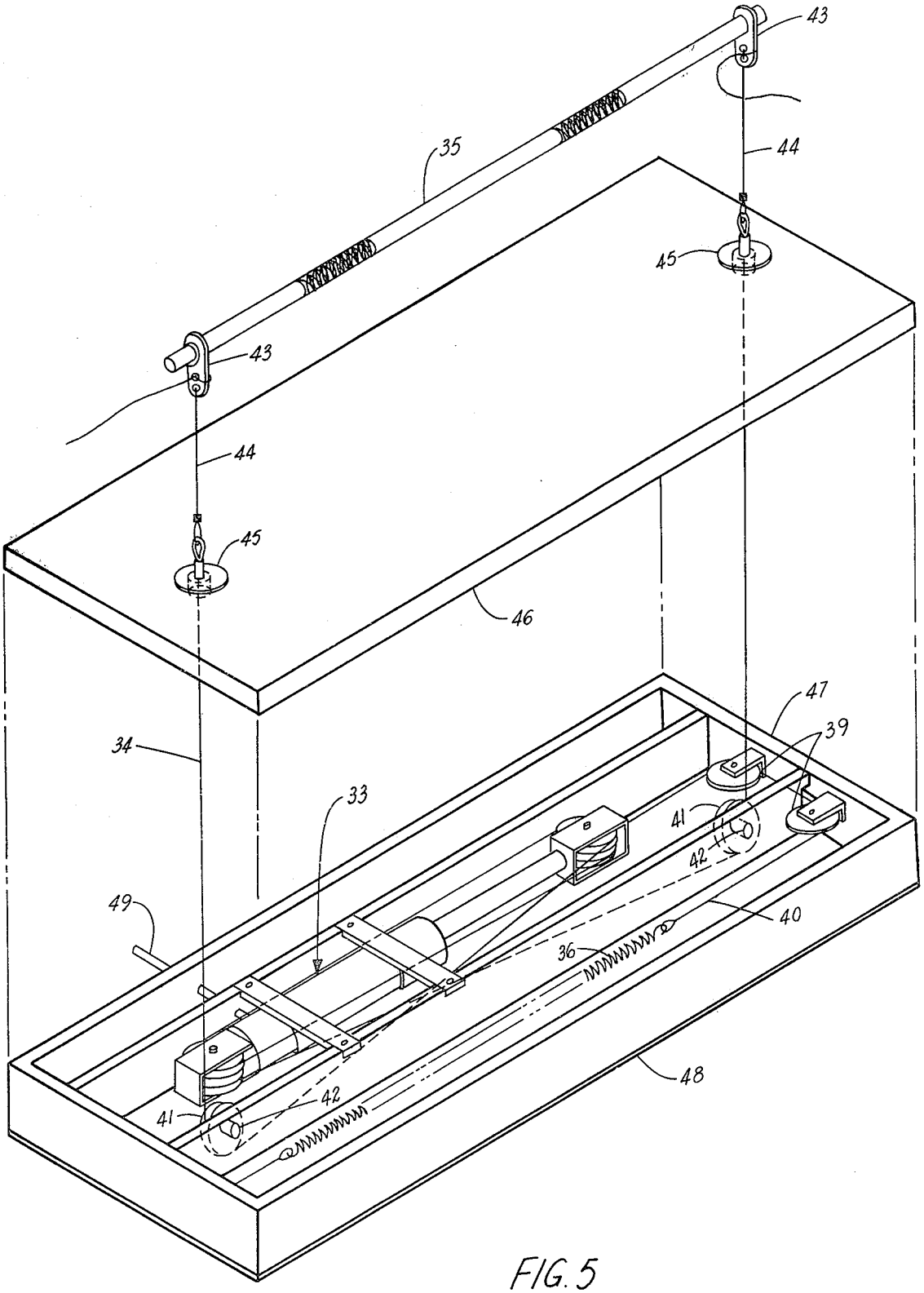
FIG. 5 is an isometric drawing of the exerciser module.

Thus, as can be seen in Figs. 4 and 5 and should be understood from the foregoing, the wire rope 29 (which serves as a load bearing, flexible line) is attached to the bar 35 (which serves as a force applying means for the user to apply exercising force) at two spaced locations. In the illustrative embodiment, two spaced pairs of sheaves 30 are associated with opposite ends of the cylinder 33, with each pair set of sheaves 30 having a common axis of rotation. A third sheave 41 is also associated with each end of the cylinder 33 and has an axis of rotation making an angle of ninety degrees with the pair of sheaves 30. The rope cable or line 34 thus extends from one location on the bar 35 down toward the cylinder 33 about and around the sheave 41 then over to and around the upper sheave 30 at the other end of the cylinder, then backover to and around upper sheave 30 at the first end. The line 34 then again goes back over to the other end over to and around the lower sheave 30 and then back over and around the lower sheave 30 at the first end and then back over to and around sheave 41, and then the line terminates by extending back up to the other one of said bar locations.

The ram 28 is used to transfer the force from the sheaves 30 and wire rope 29 to the hydraulic fluid. Also when the ram 28 is retracted into the cylinder 27, it displaces the hydraulic fluid.

A suitable seal 32 is used to prevent hydraulic fluid from leaking past the ram 28 and cylinder 27. The seal 32 shown in FIG. 4 is an O-ring type; however, any other suitable seal configuration, packing or sealing device may be used. However, a seal with low friction characteristics will give the best equipment performance.

The cylinder 27 is used to contain the hydraulic fluid. It has an opening at its rear for connection to the hydraulic control module 2.

FIG. 5 is an isometric view of the exerciser module 3, like that shown in FIG. 1. The pump 33 begins the compression stroke when tension is applied to the ends of the wire rope 29. This occurs when the bar 35 (identical to bar 8 of FIG. 1) is raised. The expansion stroke occurs as the person returns to the start of the exercise movement and lowers the bar 35. As the expansion stroke is occuring, the spring 36, which was extended in the compression stroke, will pull the ram 28 out of the cylinder 27.

All items of the pump 33 are as described previously in its description above.

The spring 36 is used to expand the pump after a compression stroke. If a spring is built into the pump 33 or if a pressurized closed loop hydraulic system is used, the spring 36 could be eliminated. The spring 36 may be the extension type or a suitably arranged compression type.

The sheaves 39 and wire rope 40 act together to transfer the spring force into the ram 28. Chain and sprockets or rope and pullies could also be used in lieu of the sheaves 39 and wire rope 40.

The sheaves 41 are used to direct the force in the wire rope 29 in a convenient and usable direction for exercising and attaching the bar 35. The sheaves 41 are rotatably mounted on the shafts 42. If chain is used, the sheaves 41 would then be replaced with sprockets.

The attachments 43 are rotatably mounted to the bar 35. The attachments 43 may be designed with a device for extending or shortening the lines 44 and locking them at the desired length. The lines 7 may be wire ropes, chains, ropes, or straps. They may be made so that they can be lengthen or shorten as desired in which case such a device would not be necessary for the attachments 43.

The stops 45 are attached near the wire rope 29 ends and are used to prevent the retraction of the ends below the top cover 46 (identical to the module cover 9 of FIG. 1).

The cover 46 serves to hide the exercise mechanism and also forms the exercise platform. The frame 47 is used for attaching the various components of the exerciser module 3. The back 48 is used to enclose the mechanism enclosed in the frame 47.

The bar 8(35) is used by the person exercising. Exercises are done using the bar 8(35) in the same manner as in barbell exercises. The bar 35 may be provided with a friction inducing surface such as knurls for easy gripping. In place of the bar 8(35) and for greater flexibility in exercise movement, individual handgrips may be used.

The tube 1 (identical to tube 49 of FIG. 5) is used to connect the exerciser module 3 hydraulically with the control module 2.

Because many varying and different embodiments may be made within the scope of the inventive concept herein taught, and because many modifications may be made in the embodiment herein detailed in accordance with the descriptive requirements of the law, it is to be understood that the details herein are to be interpreted as illustrative and not in a limiting sense.

I claim:

1. An exerciser for a human user to perform physical exercising, comprising:

human exercising force connection means for the human user to physically undergo exercising force in the performing of physical exercising for development of the human muscles, a flexible, continuous, load bearing line attached to two spaced locations on said exercising force connection means and extending away from said exercising force connection means;

a hydraulic fluid cylinder with an incompressible hydraulic liquid fluid therein associated with said exercising force connection means having a moveable piston extending out of and moveable longitudinally in said cylinder in contact with said hydraulic fluid;

a first pair of sheaves located in association with a first end of said cylinder, and a second pair of sheaves located in association with the other, opposite end of said cylinder, at least one of said second pair of sheaves being mounted on and carried by said piston, said flexible, load bearing line extending from a first location on said exercising force connection means toward said cylinder and down around one sheave of said first pair, then over to and around one of the sheaves of said second pair, then back over and around the other of the sheaves of said first pair, then back over and around the other of the sheaves of said second pair, and then extending back to the other of said two locations on said exercising force connections means, force applied to said exercising force connection means in a direction away from said cylinder causing said piston to move into said cylinder.

2. The exerciser of claim 1, wherein there is further included a support stand, said cylinder being attached to and enclosed within said support stand.

3. The exerciser of claim 2, wherein said force connection means is a rigid, straight bar disposed in a line perpendicular to the axes of rotation of all of said sheaves.

4. The exerciser of claim 1, wherein both of said sheaves of said second pair are mounted on and carried by said piston and have the same axis of rotation.

5. The exerciser of claim 4, wherein there are included at least three sheaves associated with each end of said cylinder, at least two of which have the same axis of rotation.

6. The exerciser of claim 5, wherein one of each set of three sheaves has an axis of rotation making a ninety degree angle with the axis of rotation of at least one of the remaining two sheaves of its set.

7. The exerciser of claim 1, wherein a further flexible, load bearing line is attached at one end to said piston and at its other end to a resilient biasing member whose further, other end is fixed, said resilient biasing member exerting an outwardly, moving, biasing force to said piston.

8. The exerciser of claim 1, wherein the sheaves of each pair have the same axis of rotation which is parallel to the axis of rotation of said other pair.

9. The exerciser of claim 1, wherein said piston forms a ram and wherein said cylinder and said ram comprise a single acting, positive displacement pump with common inlet and outlet ports.

* * * * *